United States Patent [19]

Janssen

[11] 4,147,817

[45] Apr. 3, 1979

[54] PROCESS FOR INSULATING ELECTRICAL CONDUCTORS WITH HEAT-RESISTANT RESINS

[75] Inventor: Harald Janssen, Stemwarde Siedlung, Fed. Rep. of Germany

[73] Assignee: Beck & Co. AG., Hamburg, Fed. Rep. of Germany

[21] Appl. No.: 703,032

[22] Filed: Jul. 6, 1976

Related U.S. Application Data

[63] Continuation of Ser. No. 432,008, Jan. 8, 1974, abandoned, which is a continuation of Ser. No. 167,533, Jul. 29, 1971, abandoned.

[30] Foreign Application Priority Data

Aug. 3, 1970 [AT] Austria ..... 267022/70

[51] Int. Cl.[2] ..... B05D 1/18; B05D 3/02

[52] U.S. Cl. ..... 427/118; 427/120

[58] Field of Search ..... 427/120, 435, 118, 434 D, 427/434 E, 316, 318, 374 R, 385 R, 385 B, 388 R

[56] References Cited

U.S. PATENT DOCUMENTS

| | | | |
|---|---|---|---|
| 2,216,234 | 10/1940 | Emig | 427/120 |
| 2,495,172 | 1/1950 | Leape | 427/123 X |
| 2,671,744 | 3/1954 | Biefeld et al. | 428/435 X |
| 2,683,100 | 7/1954 | Edgar | 428/455 X |
| 2,921,872 | 1/1960 | McGlamery | 427/120 X |
| 2,952,561 | 9/1960 | Young et al. | 427/318 X |
| 3,361,593 | 1/1968 | Sattler et al. | 428/424 X |
| 3,567,673 | 3/1971 | Payette | 260/841 X |

FOREIGN PATENT DOCUMENTS

| | | | |
|---|---|---|---|
| 1455649 | 9/1966 | France | 427/435 |
| 973377 | 10/1964 | United Kingdom | 427/120 |

*Primary Examiner*—Morris Kaplan

*Attorney, Agent, or Firm*—Sprung, Felfe, Horn, Lynch & Kramer

[57] ABSTRACT

A process for providing electrical conductors with a heat resistant, insulating coating of resin. The process comprises passing the conductors through a melt of a resin which is polyester curable through free hydroxy groups, having crosslinking equivalent weight of 400–1600, which is produced by condensation at a temperature corresponding at least to the temperature of the melt to an extent such that no substantial further condensation takes place in the melt.

20 Claims, No Drawings

PROCESS FOR INSULATING ELECTRICAL CONDUCTORS WITH HEAT-RESISTANT RESINS

This application is a continuation of Ser. No. 432,008, filed Jan. 8, 1974, which is a continuation of Ser. No. 167,533, filed July 29, 1971 each now abandoned.

This invention relates to insulation of electrical conductors with resin melts.

It is known to insulate electrical conductors, preferably copper and aluminum wires, by a treatment with wire enamels, i.e. solutions of resins in solvents containing about 15 to about 45% solids.

The resins which are being used are almost exclusively organic synthetic resins such as polyvinyl formals preferably in combination with phenolic resins, polyurethanes, epoxy resins, polyhydtantoins, polyamides, polyimides and polyamideimides. Of special importance is the use of heat-resistant resins which are curable through free hydroxyl groups, preferably non-linear polyester resins which may be modified with amide or imide groups.

Preferred solvents for the resins mentioned above include cresols and xylenols which conventionally are blended with higher boiling mixtures of aromatics (solvent naphtha).

Insulation of electrical conductors is usually effected in a continuous process in horizontal or vertical wire lacquering ovens using various enamel applicators, i.e. felts and nozzles. To achieve the minimum thickness of the enamel coating specified by the Standardizing Associations, it is necessary to apply a plurality of coatings and preferably 5 to 8 coatings. Each coating must be separately baked in the stoving oven, the temperatures necessary for the circulating air being preferably 400° to 500° C.

The draw down velocities of the enamelled wire are largely dependent upon the diameter of the bare wire, the enamel base, length of the oven and oven temperature so that generally valid data cannot be given. For example, with the vertical lacquering oven used in the examples which follow hereafter and having a shaft length of 3 meters, velocities of 5 meters/minute are reached with conventional terephthalic acid-glycol-glycerol polyesters at temperatures of about 500° C. when applying six separate coatings to a 1 mm. bare copper wire.

Many additional problems are encountered by the use of solvents for insulating electrical conductors. While the problem of uniform evaporation of the solvent absolutely necessary for achieving a smooth and satisfactorily cured enamel film can be solved by adapting the evaporation curves of the individual solvents of the mixture to one another, the removal of the solvents which are high boiling in most cases from the reaction chamber offers considerable difficulty and is only possible with a high expense of energy. If only lower amounts of energy are available, the rate of draw down must be reduced, which detrimentally affects the economy of the process. Draw down rates which are economically reasonable are achievable with the use of wire enamels having the high solvent contents mentioned above only in those cases where high amounts of energy are supplied for heating the stoving oven. Otherwise retention of solvents in the enamelled wire is to be expected, which detrimentally affects the quality of the products.

A still more serious disadvantage involved in the use of wire enamels having high solvent contents is the problem of air pollution by the solvents which have been mentioned above, and, besides, are very aggressive.

The government demands that air pollution by waste gases be reduced to a minimum, which requires expensive installations on the lacquering machines, e.g. catalyst elements.

The fact that the combustion gases are utilized in modern catalytic ovens with air circulation for preheating covers part but by no means all of the expenses additionally incurred by the use of solvents and by the storage and transportation of the solvents.

Finally, there should not be left unmentioned the extreme hazard involved in the cresolic solvents when contacting the skin and that of the aromatic solvents when inhaling the vapor. Just the latter is unavoidable in practice in most cases. Despite all of these disadvantages, the use of wire enamels containing large amounts of solvent has been considered necessary for decades up to the present to obtain satisfactory insulating enamel coatings.

The introduction of a process for insulating electrical conductors with solventless resins or with resins having a largely reduced content of solvent would represent a clear and, moreover, urgently necessary enrichement of the status of the art. Nevertheless, all of the attempts made heretofore to develop a commercially applicable process for insulating electrical conductors by molten resins were unsuccessful. The present invention relates to such a process for insulating electrical conductors from the melt. The resins used in the present process are heat-resistant resins which are curable through free hydroxyl groups, especially non-linear polyester resins which may be modified with amide or imide groups. The new process is characterized in that resins which have been produced at a condensation temperature corresponding at least to the temperature of the melt when applying the resin, which have been condensed at this temperature to an extent such that no substantial further condensation takes place in the melt, and which have cross-linking equivalent weights between 400 and 1,600 are used at an operating temperature of at least 100° C. in molten form.

The use of resins which have been synthesized at a final condensation temperature which corresponds at least to the temperature of the melt when applying the resin to the wire is an important and characterizing constituent of the process because further condensations in the molten bath and consequently increases in viscosity detrimentally affecting the process will occur when using condensation temperatures which are lower than those mentioned above. It is also critical for these reasons to use resins which have been substantially completely condensed at the temperatures mentioned above. Thus, the use of products condensed to a low degree is disadvantageous.

The cross-linking equivalent weight of the insulating resins which are curable through free hydroxyl groups is that amount of resin in grams which contains a cross-linkable, i.e. curable free hydroxyl group. It is of importance inter alia for the stability of the molten bath. As a rule, the melt becomes the more unstable the lower cross-linking equivalent weight. It should preferably range between 500 and 1500. Polyester imide resins having still lower cross-linking equivalent weights give excessively brittle coatings while the thermal stability and, above all, resistance to ageing under temperature stress of coatings of polyester imides having higher cross-linking equivalent weights is unsatisfactory. Particularly preferred for polyester imide resins are cross-linking equivalent weights of between 800 and 1300.

During their production, the resins used in accordance with the invention have been exposed to condensation temperatures of preferably at least 180° C. and more preferably in excess of 200° C.

Due to their outstanding permanent thermal stability and their satisfactory mechanical and electrical properties, those polyester imide resins in molten form are particularly useful for the process described above for insulating electrical conductors which have been produced from a mixture of aromatic dicarboxylic acid containing imide groups, aromatic dicarboxylic acids free from imide groups or the respective reactive derivatives thereof and difunctional and higher functional alcohols.

Particularly useful are those polyester imides which have been produced from terephthalic acid or esters thereof, dilmide dicarboxylic acid prepared from trimellitic anhydride and an aromatic diamine, and a difunctional and a trifunctional alcohol. Polyester imide resins of this kind are, for example, described in detail in British Pat. No. 973,377 and Austrian Pat. No. 254,964.

The molar ratio of terephthalic acid or terephthalate to diimidodicarboxylic acid in the polyester imide resins used according to the invention is preferably within the range of 1:1 to 5:1.

It is further generally preferred in accordance with the invention to use resins in molten form which have an equivalent ratio of hydroxyl groups to ester group-forming carboxyl groups in the starting reaction mixture within the range from 1.5:1 to 1.65:1. When exceeding the equivalent ratio of 1.65:1, the resins formed tend to have an excessively low molecular weight and perform unsatisfactorily in the melt while resins having an excessively high molecular weight and consequently an excessively high viscosity may be formed when using an equivalent ratio lower than 1.15:1.

Limited amounts of a solvent may be added to the resins mentioned above to reduce the melt viscosity. Particularly suitable are amounts of not more than 40% by weight and preferably not more than 15% by weight, based on the total weight of resin and solvent. It is aimed at in accordance with the invention to use as low an amount of solvent as is possible. Suitable solvents which may be added include conventional systems, i.e. preferably cresols and xylenols, but also N-alkyl pyrrolidones, dialkyl sulfoxides, dialkyl acylamides and other highly polar solvents, if desired in mixture with high boiling aromatic blending agents such as solvent naphtha.

The preferred use of not more than 15% of solvent results also from the fact that resin pellets having higher contents of solvent cake together, especially at elevated ambient temperatures. Just the possibility of using granulated solid resins, due to the convenient and clean proportioning, is a further advantage of the process as compared with the prior art described above.

The process according to the invention is conveniently carried out at temperatures between 100° and 220 °C. and preferably between 150° and 200° C.

A lower limit is set to the operating temperature by the particular viscosity of the molten resin. For example, the polyester imide resin produced according to Example 1 has a viscosity of about 10,000 cp. at about 150° C. This viscosity level should not be exceeded in many cases became otherwise an undesirable expansion of the metallic conductor, e.g. of a thin copper wire, may occur due to the high mechanical resistance of the melt.

The upper limit of the operating temperature is primarily dependent upon the stability of the molten resin. Excessively high temperatures of the bath involve the risk of molecular growth or of degradation processes.

As may be seen in detail from the examples, it is possible with the use of the process according to the invention even with one pass through the molten bath to apply the baking insulation with a coating thickenss which is several times, e.g. at least four times and preferably even five or six times the coating thickness previously obtained in one passage. Nevertheless, insulations of supreme quality are obtained. This constitutes a substantial deviation from operating instructions the observation of which was previously considered mandatory in lacquering industry. However, the process of the invention is not restricted to once-through operation through the melt. Application of a plurality of resin coatings, e.g. with two to four passes or more, is contemplated within the scope of the invention. In this case, lower coating thicknesses may be used per pass.

Moreover, it is to be noted that the characteristics of the resin insulation prepared according to Example 1 have been obtained without the addition of the metallic additives such as titanates to the polyester imide resin as being usual and necessary in case of solvent-containing enamels. This fact is of importance in view of the economy of the process. However, it is not intended that this indication preclude the additional use of such metallic additives.

It may further be preferred in the process according to the invention to preheat the electrical conductor to be insulated prior to introducing it into the melt. Preheating to temperatures within the range of the temperature of the molten resin may be particularly desirable. This measure avoids the resistance or restraining effects due to deposition of prematurely solidified resins.

EXAMPLE 1

Production of the resin

To produce a polyester imide resin having an equivalent ratio of hydroxyl groups to ester group-forming carboxyl groups of 1.40:1, a molar ratio of terephthalic acid dimethyl ester to diimide dicarboxylic acid of 2.36:1, and a cross-linking equivalent weight of 9.43 (all data based on the solventless resin), 95 g. of xylenol, 112 g. (1.8 moles) of ethylene glycol, 261 g. (1.0 mole) of trishydroxyethyl isocyanurate (THEIC), and 320.4 g. (1.65 moles) of dimethyl terephthalate are heated to 170° C. with stirring in a 2 liter ground flask provided with a stirrer and having a water separator attached thereto.

While still at 100° C., 268.8 g. (1.4 moles) of trimellitic anhydride and 138.6 g. (0.7 moles) of 4,4'-diaminodiphenyl methane are added to the mixture. At 130° C., an exothermic reaction begins. Up to 150° C., the contents of the flask thicken by formation and precipitation of the yellow imidocarboxylic acid, and the reaction condensate begins to separate.

In the separator, 140 to 156 g. (97 to 100%) of a water-methanol mixture distilling at overhead temperatures between 95 and 100° C. are obtained as condensate.

After a temperature of 170° C. has been reached, the temperature of the flask is increased at a rate of 5° C. per hour. At 190° C., the contents of the flask become clear and are condensed at 215 to 225° C. until a Durrans softening point of 116° C. has been reached. After brief cooling the molten resin is mixed with 73 g. of xylenol at 190°-200° C. and, after adequate intermixing, filled into containers as 85% resin or pelletized.

Insulation of the electrical conductor

The coating test described hereafter was carried out continuously on a 1 mm. bare copper wire with a 3 m. vertical oven at a temperature of the oven of 520° C. and a draw down rate of 4 to 5 meters per minute.

The resin produced in the manner described above was melted in a heated apparatus and introduced into the heated lacquering vessel. The lacquering vessel contains in its lower part a wire guide and in its upper part a doctor orifice the bore of which determins the thickness of the coating. An orifice having a bore of 1.10 mm. was used in this test.

The coating thickness of the enamel of 50 microns specified by DIN 46435 for this diameter of the bare wire could be achieved with a single pass in continuous operation.

A 30% solution in creson-xylenol-solvent naphtha which was prepared from this resin with the addition of 2% based on solid resin of butyl titanate and which is conventionally used for wire insulation had to be applied by the conventional mode of operation decribed above in six passes to obtain the same coating thickness at about the same draw down rate, i,e. a coating thickness of only about 8 microns was achieved in one pass. The solution contained in the lacquering vessel was maintained at a constant temperature of 170° C. throughout the test period of about 8 hours by means of a control device. The viscosity of the solution at this temperature was 3000 cps. and did not change substantially during the test period of 8 hours. Before entering the lacquering vessel, the bare wire was preheated to about the temperature of the bath by means of an electrical heater. The enamelled wire produced by the process according to the invention had the folllowing characteristics:

| | |
|---|---|
| Suface hardness (pencil hardness) according to DIN 46453 (German Standard Specification) | 4 H |
| Peel test according to IEC | 220 |
| Tear test (snap test according to Nema MW 1000-1967) | satisfactory |
| Resistance of the insulation to coiling of the wire after 25% prestretch | 1 × (= 87.5%) |
| Heat shock test | 2 hrs. at 180° C. after 10% prestretch, 1 × satisfactory |
| Softening temperature (DIN 46453) | 315° C. |

These characteristics correspond to the values which are obtained with the above-mentioned 30% solution, but with the addition of 2% of butyl titanate, based on solid resin, when operating in conventional manner. The hardness which is higher by one step is remarkable (conventionally, 3 H).

EXAMPLE 2

Production of resin

A polyester imide resin having an equivalent ratio of hydroxyl groups to ester group-forming carboxyl groups of 1.48:1, a molar ratio lf dimethyl terephthalate to diimidodicarboxylic acid of 2.36:1 and a cross-linking equivalent weight of 700 (all values based on the solventless resin) is prepared by heating 100.0 g. of xylenol, 65.72 g. (1.06 moles) of ethylene glycol, 271.6 g. (1.4 moles) of dimethyl terephthalate, 334.08 g. (1.28 moles) of trishydroxyethyl isocyanaurate (THEIC), 230.54 g. (1.2 moles) of trimellitic anhydride, and 118.8 g. (0.6 moles) of 4,4'-diaminodiphenyl methane to 170° C. with stirring in a 2 liter ground flask provided with a stirrer and having a water separator attached thereto.

At 130° C., an exothermic reaction begins. Up to 150° C., the contents of the flask thicken by formation and precipitation of the yellow imidocarboxylic acid, and separation of the reaction condensate begins.

In the separator, 120-125 g. (97-100%) of a water-methanol mixture distilling at overhead temperatures between 95° and 100° C. are obtained as condensate. After a temperature of 170° C. has been reached, the temperature of the flask is increased at a rate of 5° C. per 30 minutes. At 190° C., the contents of the flask become clear and the contents are condensed at 205° to 215° C. until a softening point according to Durrans of 120° C. has been reached.

After brief cooling, the molten resin is filled into containers as a 90% resin or pelletized.

Insulation of the electrical conductor

Coating of the wire with the polyester imide resin prepared according to Example 2 was effected with the same oven under the same conditions. However, the temperature of the molten bath was 10° C. lower than in Example 1, i.e. 160° C.

It was possible also with this resin to achieve the necessary coating thickness of 50 microns with a single pass. The enamelled wire had the following characteristics:

| | |
|---|---|
| Surface harness according to DIN 46453 (Pencil hardness) | 5 H |
| Peel test according to IEC 251-1 | 191 |
| Tear test (snap test according to Nema MW 1000-1967) | satisfactory |
| Resistance of the insulation to coiling of the wire after 25% prestretch | 1.5 × (72.5%) |
| Heat shock test | 1 hr. at 200° C. 1 × 0 satisfactory |
| Softening temperature according to DIN 46453 | 345° C. |

These characteristics correspond to the values which are obtained with the above-mentioned 30% solution when operating in conventional manner, but with the addition of 2% based on solid resin of butyl titanate. Here again, the hardness which is higher by one step is noteworthy (conventional hardness, 4 H).

What is claimed is:

1. A process for electrically insulating a wire electrical conductor with a heat resistant resin which comprises only once or twice applying a melt of the resin to the conductor at an operating temperature of at least 100° C. by passing the conductor through the melt to form a coating of the resin on the conductor, and baking the coating following each application for curing of the resin, said resin being a polyester imide curable through free hydroxy groups, having a cross-linking equivalent weight of 500-1500, produced by condensation at a temperature corresponding at least to the temperature of the melt to an extent that no substantial further condensation takes place in the melt, the equivalent ratio of hydroxyl groups to ester forming carboxyl groups in the reaction mixture corresponding to said polyesterimide being within the range of 1.15:1 to 1.65:1, the hardness of the insulation being at least 4H.

2. The process according to claim 1 wherein said resin is polyester imide resin which has been produced from a mixture of aromatic dicarboxylic acids containing imide groups, aromatic dicarboxylic acids free from imide groups, or the respective reactive derivatives thereof, and difunctional, and higher functional alcohols.

3. The process of claim 1 wherein said is resin polyester imide in molten form which has been produced from terephthalic acid or esters thereof, diimidodicarboxylic acid prepared from trimellitic anhydride and an aromatic diamine, and a difunctional, and a trifunctional alcohol.

4. The process of claim 3 said resin having been prepared with a molar ratio of terephthalic acid or its ester to diimidodicarboxylic acid within the range from 1:1 to 5:1.

5. The process of claim 1 wherein said coating is effected at an operating temperature of 100° to 220° C.

6. The process of claim 1 wherein the electrical conductor to be insulated is preheated prior to being introduced into the molten resin.

7. The process of claim 1 wherein said resin is heated to final temperatures in excess of 180° C. during said condensation.

8. A process according to claim 1, wherein said coating is affected at an operating temperature of 150° to 200° C.

9. A process according to claim 6, the conductor being preheated to the temperature of the molten resin.

10. A process according to claim 1 wherein said resin is heated to a final temperature in excess of 200° C. during said condensation.

11. Process according to claim 1, the resin being a solid resin at normal temperature and being melted to form said melt.

12. Process according to claim 1, the resin being a solid resin at normal temperature and being melted to form said melt.

13. Process according to claim 4, said cross-linking equivalent weight being 800–1300.

14. Process according to claim 13, the melt being free of metallic additives.

15. A process according to claim 1, said cross-linking equivalent weight being 800–1300.

16. Process according to claim 1, the melt being free of metallic additives.

17. Process according to claim 4, the melt being free of metallic additives.

18. Process according to claim 13, the melt comprising not more than 15% by weight of solvent based on the total weight of resin and solvent.

19. Process according to claim 1, the melt comprising not more than 15% by weight of solvent based on the total weight of resin and solvent.

20. Process according to claim 4, said cross linking equivalent being 800–1300.

* * * * *

UNITED STATES PATENT AND TRADEMARK OFFICE

CERTIFICATE OF CORRECTION

PATENT NO. : 4,147,817

DATED : April 3, 1979

INVENTOR(S) : Harald Janssen

It is certified that error appears in the above-identified patent and that said Letters Patent are hereby corrected as shown below:

Title page priority, change "267022/70" to -- 7026/70--.

Column 3, line 26, change "254,964" to --254,963--.

Column 5, line 26, change "creson" to --cresol--.

Column 6, line 45, change "0" to --Ø--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*